US006928990B2

(12) United States Patent
Meiller et al.

(10) Patent No.: US 6,928,990 B2
(45) Date of Patent: Aug. 16, 2005

(54) EVAPORATIVE EMISSIONS CANISTER ASSEMBLY AND APPARATUS

(75) Inventors: Thomas Charles Meiller, Pittsford, NY (US); Alexander E. Shneydman, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 20 days.

(21) Appl. No.: 10/668,512

(22) Filed: Sep. 23, 2003

(65) Prior Publication Data

US 2005/0061301 A1 Mar. 24, 2005

(51) Int. Cl.[7] ..... F02M 37/04
(52) U.S. Cl. ..... 123/519; 123/518
(58) Field of Search ..... 123/516, 518, 123/519, 520

(56) References Cited

U.S. PATENT DOCUMENTS 3,730,158 A * 5/1973 St. Amand ..... 123/519
5,098,453 A 3/1992 Turner et al.
5,718,209 A 2/1998 Scardino et al.
5,743,943 A 4/1998 Maeda et al.
5,776,227 A 7/1998 Meiller et al.
5,776,228 A 7/1998 Meiller et al.
5,875,765 A * 3/1999 Norton ..... 123/520
6,237,574 B1 5/2001 Jamrog et al.
6,279,548 B1 8/2001 Reddy

* cited by examiner

*Primary Examiner*—Mahmoud Gimie
(74) *Attorney, Agent, or Firm*—Jimmy L. Funke

(57) ABSTRACT

A canister for an evaporative emissions control system that comprises a canister package with an interchangeable cartridge. The specific cartridge selected for use in the canister package is determined primarily based upon emissions regulatory requirements of the device that uses the canister. The need for a common canister package with an interchangeable cartridge simplifies packaging and assembly of the canister into any device, whether a vehicle or a stationary device, or a handheld tool. For example, a common canister package reduces need for testing, development and certification associated with use of multiple canister packages on a common vehicle platform.

22 Claims, 3 Drawing Sheets

EVAPORATIVE EMISSIONS CANISTER ASSEMBLY AND APPARATUS

TECHNICAL FIELD

This invention pertains generally to a canister for capturing and storing evaporative emissions from a fuel storage and delivery system of a device, such as a vehicle.

BACKGROUND OF THE INVENTION

Fuel that evaporates from fuel storage and delivery systems of various devices, including vehicles, equipment, and tools that use internal combustion engines, has the potential to contribute a significant portion of ozone-depleting emissions into the atmosphere. Various regulatory agencies seek to reduce evaporative emissions by requiring manufacturers of these devices to comply with regulations as a condition for offering their products for sale in the agency's jurisdiction. These regulations have led to the development and implementation of systems that capture evaporative emissions. A substantial portion of the regulatory effort focuses on capturing and controlling evaporative emissions from passenger vehicles with internal combustion engines.

Evaporative emissions are typically generated when stored fuel, generally from a fuel tank or other fuel storage device, evaporates and escapes into the atmosphere. Manufacturers of vehicles and other products that use internal combustion engines are required by law to implement systems that capture evaporative emissions and prevent their release into the atmosphere. Evaporative emissions control systems are designed to ensure that fuel vapors from the fuel storage tank of a vehicle are not emitted into the atmosphere, but are captured, stored, and subsequently used by the vehicle, in compliance with regulatory standards. Evaporative emissions control systems are typically used on vehicles and other products, and comprise a fuel vapor storage device, referred to as an evaporative canister, that has a fluid connection a fuel storage tank, and a fluid connection to an intake of the internal combustion engine. The evaporative canister is a sealed container that includes a predetermined volume of adsorbent material for adsorbing fuel vapors. Evaporated fuel vapors (typically hydrocarbons) are inlet to the canister through a vapor inlet port that is attached to the fuel tank. There is a purge port in the canister that is fluidly attached via tubing to an inlet of the intake of the engine. There is a fresh air inlet to the canister. There are other devices on the canister, including valves and sensors, which are necessary for complete operation and diagnosis of the canister and evaporative system. In operation, fuel vapors flow with air from the fuel storage system to the canister and are adsorbed onto the adsorbent material. Flow is caused by increased pressure that is created in the fuel storage system as the fuel evaporates. When operating, the intake of the engine typically generates a negative pressure that may be used to cause flow of air from the fresh air inlet through the canister and into the engine. When air flows through the canister the adsorbed fuel vapors are desorbed from the adsorbent material and flowed into the engine intake, wherein they are burned by the engine as part of ongoing engine operation. There are other aspects of the evaporative system, including diagnostics and on-board vapor recovery systems that are part of the operation of the evaporative system but not directly affected by the specific invention.

Demonstration of compliance to regulatory emissions standards includes subjecting the device, typically a motor vehicle, to predetermined test conditions and measuring the net generation of evaporative emissions. The regulatory agencies, including the California Air Resources Board ("ARB") and the United States Environmental Protection Agency ("USEPA") have developed test procedures to determine regulatory compliance. Representative vehicles are subjected to the test procedures and evaporative emissions are measured. Typically, proof of compliance and accompanying certification of an evaporative system for a vehicle line is based upon whether the quantity of evaporative emissions of the vehicle measured during the test procedures falls below a mandated threshold. A typical test procedure includes vehicle preparation, wherein the canister is preloaded with a volume of hydrocarbons, and a preparatory cycle, wherein the vehicle is operated for a predetermined cycle. The vehicle is then subjected to a soak cycle, wherein the vehicle is soaked for a predetermined amount of time in a sealed chamber. During the soak cycle, the vehicle is subject to diurnal temperature variations that range from 65° F. (18° C.) to 105° F. (40° C.) for the ARB test procedure, or 72° F. (22° C.) to 96° F. (36° C.) for the USEPA test procedure. Evaporative emissions are collected from the sealed chamber, measured and analyzed during the course of the test to obtain an emissions value. One test procedure is called a two-day diurnal, wherein the vehicle is operated over a preparatory cycle and then soaked for two days in a sealed chamber. Another test procedure is called a three-day diurnal, wherein the vehicle is operated over a preparatory cycle and then soaked for three days in a sealed chamber. Current evaporative emissions thresholds mandated from ARB and USEPA require that a passenger car emit less than 2.5 grams of hydrocarbon vapors during a two-day diurnal test. The evaporative emissions thresholds mandated from the USEPA include a Tier 2 emissions standard, wherein a passenger vehicle must emit less than 0.95 grams of hydrocarbon vapors during a three-day diurnal test. New evaporative emissions standards from the ARB include a LEV II standard, wherein the threshold mandated for a passenger vehicle is 0.5 grams of hydrocarbon vapors measured during a three-day diurnal test. The ARB also has a PZEV standard, wherein the threshold mandated for a passenger vehicle is 0.35 grams of hydrocarbon vapors measured during a three-day diurnal test plus a two-day diurnal test. The PZEV test procedure includes a rig test of the evaporative emissions systems, which comprises assembling the components of the fuel system including the fuel tank, canister, fuel lines and fuel injection system onto a cart. The rig is subjected to the three-day diurnal test plus the two-day diurnal test, and the rig must emit less than 54 milligrams of hydrocarbon vapors to pass the PZEV standard.

Evaporative canisters designed to meet the Tier 2 and LEV II emissions standards typically comprise conventional elements of a canister, as previously described. Evaporative canisters designed to meet PZEV emissions standards include conventional canister elements, and add some form of hydrocarbon scrubber device. The hydrocarbon scrubber is typically a ceramic monolith device added to the air inlet of the canister to capture and adsorb low-level hydrocarbon bleed emissions that may occur during the test procedure. The addition of the hydrocarbon scrubber increases the complexity of the canister and adds cost. The hydrocarbon scrubber must be packaged into allotted vehicle space and meet all other emissions and safety standards.

Only certain quantities of vehicles are required to meet the stringent PZEV standards. Therefore vehicle manufacturers are reluctant to burden all vehicles with the added cost and complexity that is incident to meeting PZEV requirements. This requires that the vehicle manufacturer be able to design and validate more than one canister package for a vehicle line. In addition, each manufacturer must select and assemble more than one canister package into a vehicle during vehicle assembly process. The addition of components such as the scrubber may complicate the assembly process by adding or changing assembly procedures, depending upon the specific canister required.

Therefore, there is a need to provide a common package for an evaporative canister used on a device, such as a motor vehicle, intended to meet various emissions regulations. There is a need to reduce package and tooling costs for evaporative canisters, and provide flexibility in packaging. There is a further need to provide a canister package with an interchangeable cartridge, wherein the cartridge selected for use in the canister is determined based upon regulatory requirements of the device. A common canister package with an interchangeable cartridge simplifies packaging and assembly of the canister into any device. A common canister package reduces need for testing, development and certification associated with use of multiple canister packages on a common vehicle platform.

SUMMARY OF THE INVENTION

The present invention provides an improvement over a conventional canister that is part of an evaporative emissions control system, by providing a canister package with an interchangeable cartridge. The cartridge selected for use in the canister is determined primarily based upon emissions regulatory requirements of the device. The need for a common canister package with an interchangeable cartridge simplifies packaging and assembly of the canister into any device, whether a vehicle or a stationary device, or a handheld tool. A common canister package reduces need for testing, development and certification associated with use of multiple canister packages on a common vehicle platform. The invention comprises a canister for capturing and storing fuel vapors generated by a device, including a housing, and a cartridge that is sealably assembled within. The cartridge is one of a plurality of cartridges that is operable to capture and store at least a portion of the fuel vapors from the device. The specific cartridge is selected based upon a measure of the fuel vapors from the device generated during predetermined conditions. The predetermined conditions may comprise a two-day diurnal test plus a hot soak, or a three-day diurnal test plus a hot soak, or some other conditions.

The canister housing typically includes conventional elements, including an air inlet, a purge outlet, and a vapor inlet, as well as a chamber containing a predetermined quantity of hydrocarbon adsorption material. The cartridge is inserted into a cartridge chamber wherein an end of the cartridge engages a sealing surface that is adjacent to the air inlet, to create a fluid seal. Substantially all fluid communication from the air inlet into the canister occurs through the cartridge.

A cartridge may comprise a container filled with a predetermined quantity of hydrocarbon adsorption material. A cartridge may instead comprise a container filled with a predetermined quantity of hydrocarbon adsorption material and a hydrocarbon scrubber device. A cartridge may be fixably attached to the canister housing using a fitting attached to an end of the cartridge. A cartridge may instead be fixably attached to the canister housing using a cover of the housing that compressibly holds the canister in place.

These and other aspects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF THE PREFERRED EMBODIMENT

Figure 1:
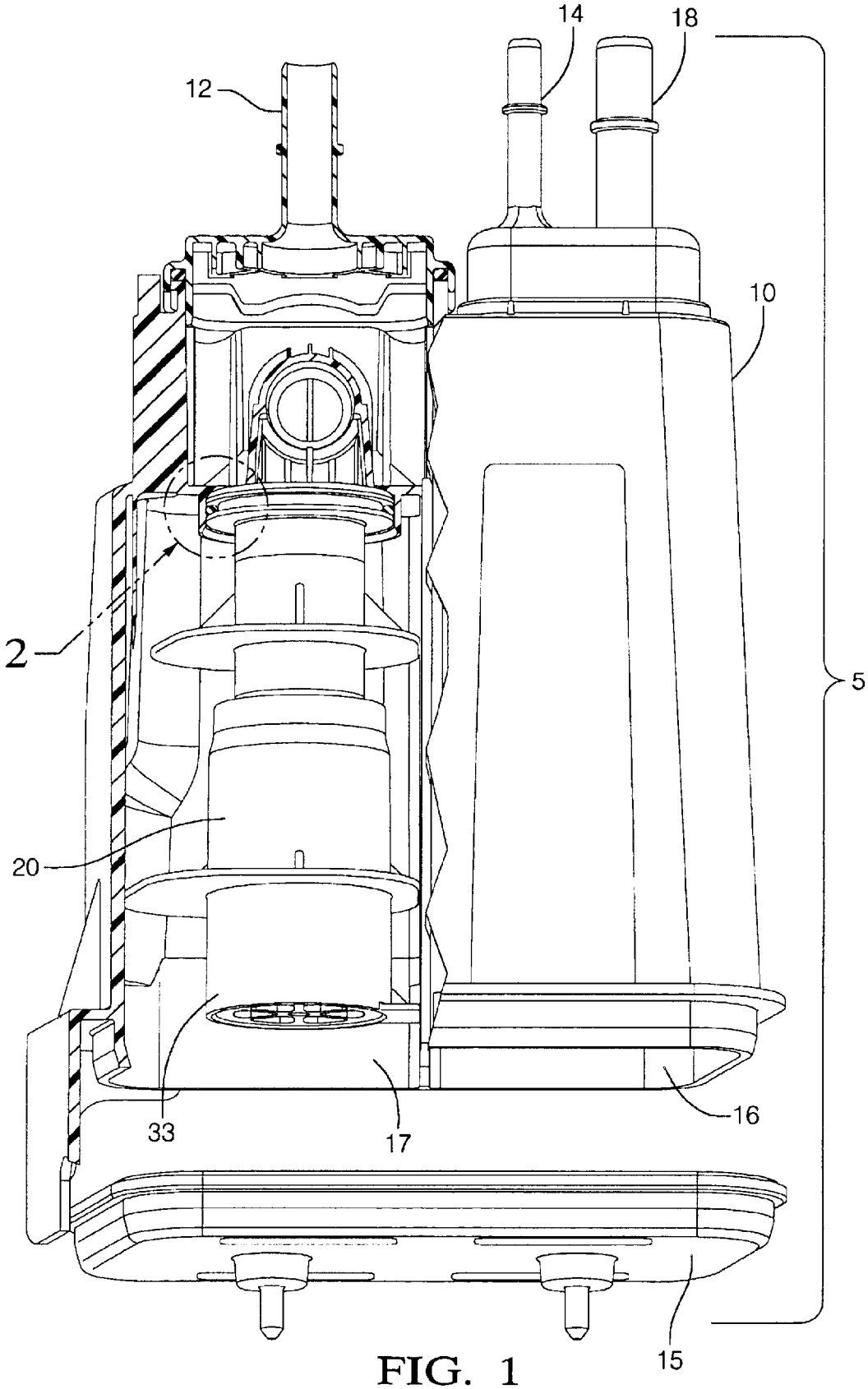
FIG. 1 is a drawing of an evaporative canister, in accordance with the present invention.

Referring now to the drawings, wherein the showings are for the purpose of illustrating an embodiment of the invention only and not for the purpose of limiting the same, FIG. 1 shows a canister assembly 5 which has been constructed in accordance with the present invention. The canister assembly 5 is an integral component of an evaporative emissions control system that manages fuel vapors for a device with an internal combustion engine, which is a motor vehicle in this embodiment. The canister assembly 5 is preferably located in a secure location of the motor vehicle (not shown). Other components of the evaporative emissions control system include a fuel tank; an engine; a fuel system; interconnecting tubing for fluid flow between the engine, the fuel tank and the canister; and sensors, solenoid control valves, and wiring harnesses for controlling flow of air and fuel vapors between the components (not shown). Each of the components as well as the system are designed to meet regulatory requirements, including those related to vehicle safety and emissions. Physical requirements for the canister assembly 5 include that material used for a canister housing 10 must resist permeation by various fuel constituents, including gasoline and alcohol. Other physical requirements include that the canister assembly 5 must meet temperature and vibration durability requirements derived based upon the specific vehicle application; and the canister assembly 5 must meet or exceed all applicable safety tests required for the specific vehicle application. Overall design of canister assemblies to meet regulatory, performance, and physical requirements is known to one skilled in the art.

The canister assembly 5 is preferably comprised of the housing 10 fluidly attached to inlets and outlets, each described hereinafter. The housing 10 is preferably constructed by molding substantially impermeable material into a predefined configuration. A vapor inlet 18 to the housing 10 of the canister assembly 5 is fluidly attached to the fuel storage tank (not shown) of the vehicle via a flow tube (not shown). There is a purge outlet 14 attached to the housing 10 that permits flow of air and fuel vapors between the canister assembly 5 and an intake system (not shown) of the internal combustion engine (not shown). There is an air inlet 12 to the housing 10 that permits flow of air through the canister assembly 5. The air inlet 12 is typically attached to the air intake system (not shown) of the engine after an air filtering system. The canister assembly may include flow valves and pressure sensors to facilitate complete use and diagnosis of the canister assembly 5 and the evaporative emissions system (not shown). Canisters and evaporative emissions systems are known to one skilled in the art.

Referring again to FIG. 1, the canister assembly 5 in this embodiment is preferably comprised of the housing 10, including a housing chamber 16 and a cartridge chamber 17, and a bottom cover 15. The housing chamber 16 is located in the housing 10 and is fluidly attached to the vapor inlet 18 and the purge outlet 14. The housing chamber 16 preferably contains a predetermined quantity of hydrocarbon adsorption material (not shown) operable to capture and store at least a substantial portion of the quantity of fuel vapors generated from the fuel tank. The hydrocarbon adsorption material preferably comprises a predetermined quantity of pelletized activated carbon particles (not shown) operable to capture and store fuel vapors by adsorbing hydrocarbon molecules onto the surface of each particle. The hydrocarbon adsorption material is preferably held in place by a compression screen (not shown). Use of the hydrocarbon adsorption material is generally known to one skilled in the art.

Figure 2:
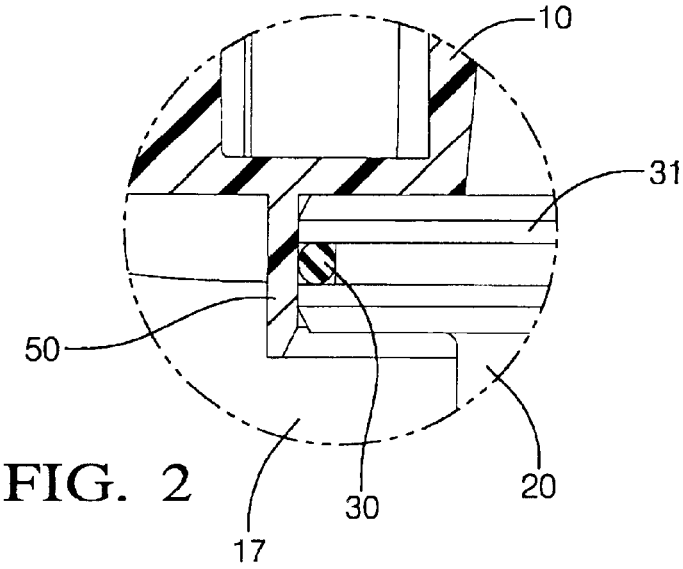
FIG. 2 is a detail of the evaporative canister, in accordance with the present invention; and, FIGS. 3A, 3B, and 3C are cartridges for an evaporative canister, in accordance with the present invention.

The cartridge chamber 17 of the housing 10 preferably comprises an opening within the housing 10 adjacent to the housing chamber 16, and includes the air inlet 12 and a sealing surface 50 substantially adjacent the air inlet 12. The sealing surface 50 is preferably molded into the interior portion of the cartridge 17 and has a cylindrical cross-section. The sealing surface 50 is designed to interact with a first end of one of a plurality of cartridges 20 to create a vapor seal therebetween. This is shown in detail in FIG. 2A. All airflow through the air inlet 12 passes through the cartridge 20 as a result of the vapor seal. A preferred flowpath for air and fuel vapors through the canister assembly 5 comprises flow through the vapor inlet 18 and the purge outlet 14, to the hydrocarbon adsorption material contained in the housing chamber 16, across the bottom cover 15 to an opening at a second end 33 of the cartridge 20, to hydrocarbon adsorption material contained in the cartridge 20, and to the air inlet 12.

Figure 3A:
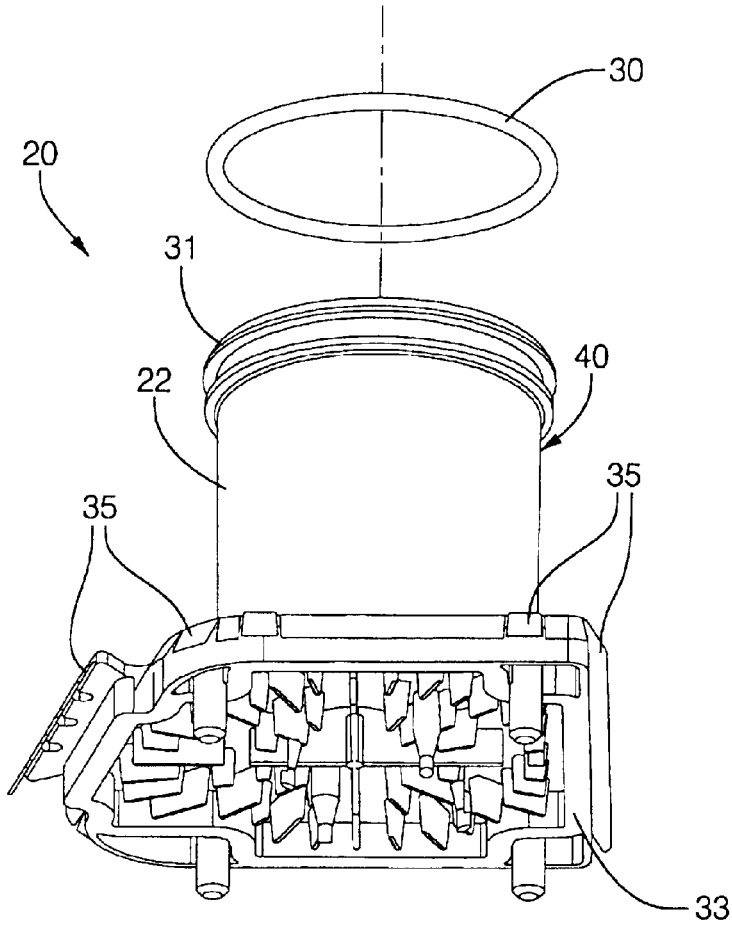
Figure 3B:
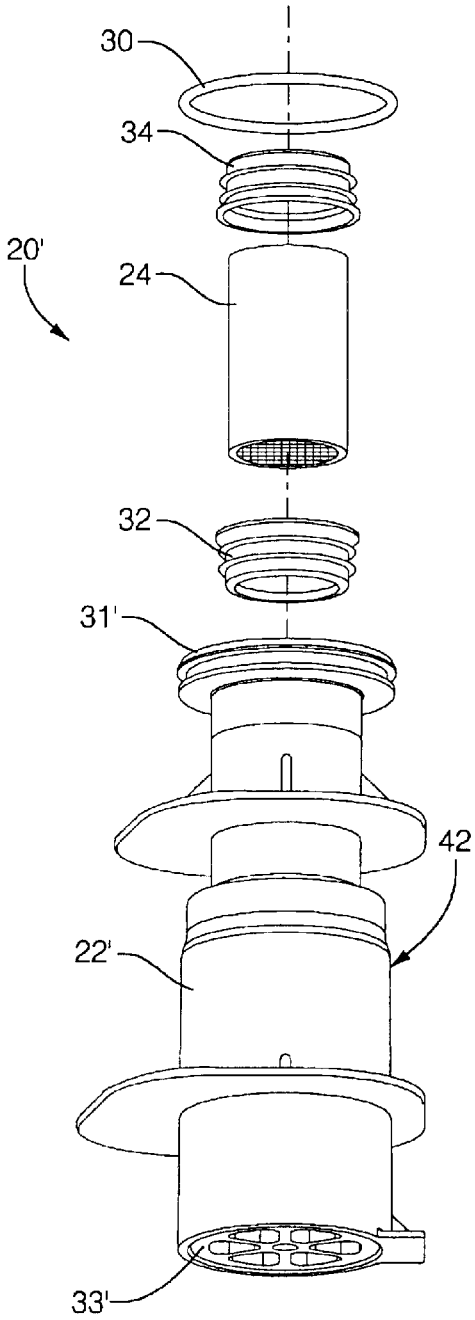
Figure 3C:
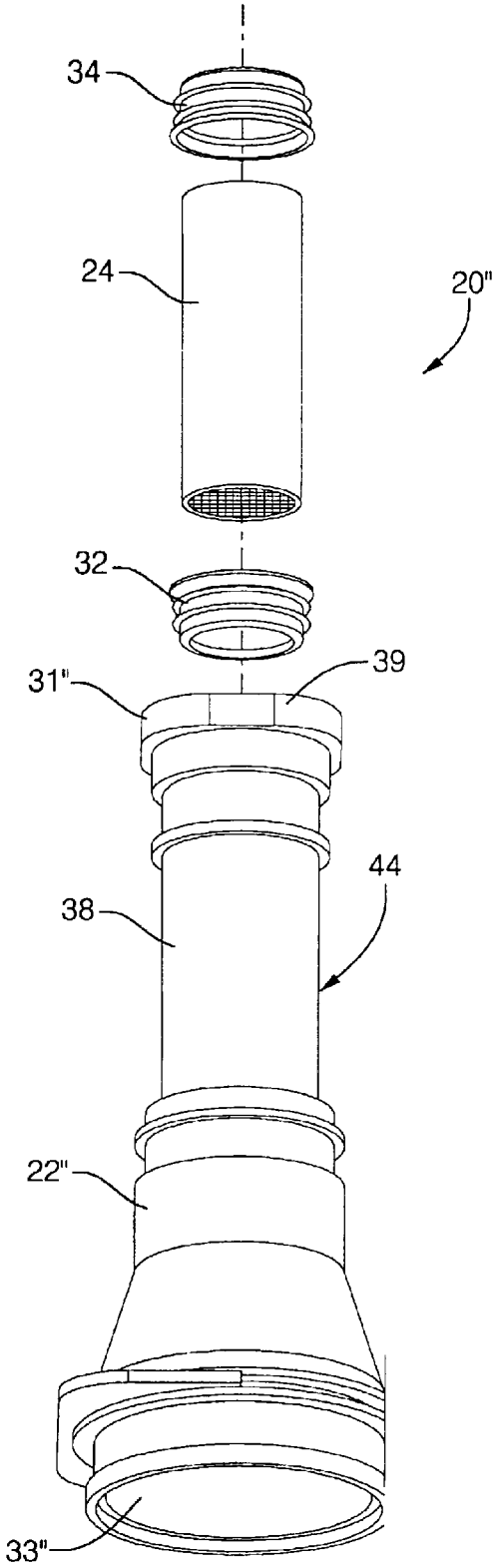

Referring now to FIGS. 3A, 3B, and 3C, embodiments of the cartridges 20 are shown. Each of the cartridges 20 comprise an interchangeable device operable to seal against the sealing surface 50, and containing materials capable of capturing and storing fuel vapors from the fuel storage tank, including pelletized activated carbon particles, and others described hereinafter. The first end 31 of each of the plurality of cartridges 20 comprises an opening in the cartridge that is designed and manufactured to join the sealing surface 50 of the housing chamber 16. Fluid communication between the air inlet 12 and the canister housing 10 occurs exclusively through the cartridge 20, as described previously, when the first end 31 is joined to the sealing surface 50. The opening at the second end 33 of each cartridge 20 is intended to allow flow of air and fuel vapors into and out of the cartridge 20.

Referring again to FIG. 3A, the first embodiment of the invention, including a first cartridge 40, of the plurality of cartridges 20, is shown. The first end 31 is preferably cylindrical in shape, and designed to be inserted inside the sealing surface 50 contained in the cartridge chamber 17 of the canister housing 10. A sealing device 30, in this embodiment shown as an O-ring, is placed between the first end 31 and the sealing surface 50 and sealably engages the first end 31 the sealing surface to effect a complete vapor seal. This is shown in more detail in FIG. 2. There is a plurality of fittings 35 attached at or near the second end 33 of the first cartridge 40 that conform to the shape of the interior of the cartridge chamber 17. The plurality of fittings 35 preferably engage the inner wall of the cartridge chamber 17 and form a compression fitting to fixably secure the first cartridge 40 into the cartridge chamber 17. The first cartridge 40 includes a storage chamber 22 preferably filled with a sufficient quantity of pelletized activated carbon particles that are used as hydrocarbon adsorption material.

Referring again to FIG. 3B, a second embodiment of the invention is shown, wherein a second cartridge 42 of the plurality of cartridges is shown. The first end 31 is preferably cylindrical in shape, and designed to be inserted inside the sealing surface 50 contained in the cartridge chamber 17 of the canister housing 10. A sealing device 30, in this embodiment shown as an O-ring, is placed between the first end 31 and the sealing surface 50 and sealably engages the first end 31 the sealing surface to effect a complete vapor seal. This again is shown in more detail in FIG. 2. The second cartridge 42 is fixably secured in the housing 10 using the bottom cover 15 of the housing 10 at the second end 33 of the second cartridge 42. The second cartridge 42 preferably includes the storage chamber 22 filled with a sufficient quantity of pelletized activated carbon particles used as hydrocarbon adsorption material, and a hydrocarbon scrubber 24. The hydrocarbon scrubber 24 is preferably a ceramic honeycomb monolith device and is operable to adsorb fuel vapor bleed emissions that may occur during vehicle soak. The pelletized activated carbon particles are preferably placed and secured in the second cartridge 42 near the second end 33. The hydrocarbon scrubber 24 is preferably securely placed in the second cartridge 42 near the first end 31. The hydrocarbon scrubber 24 is secured in place in the second cartridge 42 using mounting seals 32, 34 that are operable to prevent flow of air or fuel vapors between the second cartridge 42 and the hydrocarbon scrubber 24. Hydrocarbon scrubbers are known to one skilled in the art.

Referring again to FIG. 3C, a third embodiment of the invention is shown, wherein a third cartridge 44 of the plurality of cartridges is shown. The third cartridge 44 comprises a physical configuration designed to provide additional volume to store a quantity of pelletized activated carbon particles. The first end 31 of the cartridge 20 includes a fitting 39 sealably assembled onto the first end 31, and designed to mate with the sealing surface 50 contained in the cartridge chamber 17 of the canister housing 10. The fitting 39 preferably has a cylindrical cross-section that sealably engages the outside portion of the sealing surface 50 contained in the cartridge chamber 17 of the canister housing 10 to effect a vapor seal. The hydrocarbon scrubber 24 in this embodiment is contained in a second section 38 of the cartridge 20. The storage chamber 22 of this embodiment contains the pelletized activated carbon particles. The storage chamber 22 is configured to fit into the cartridge chamber 17 and contain an additional volume of the pelletized activated carbon particles, as compared to the second cartridge 42 or the first cartridge 40. The third cartridge 44 is fixably secured in the housing 10 using the bottom cover 15 of the housing 10 at the second end 33 of the first cartridge 40.

The invention includes a method to assemble the canister 5 for adsorbing fuel vapors from the device with the internal combustion engine, which is the motor vehicle in this embodiment. The method comprises selecting one of the plurality of cartridges 20 based upon a quantity of evaporating fuel generated by the device under predetermined conditions and assembling the selected cartridge 20 to the housing 10 of the canister 5. Assembling the selected cartridge 20 to the housing 10 of the canister 5 comprises inserting the first end 31 of the cartridge 20 into the housing 10 until the first end 31 sealably engages the sealing surface 50 of the housing 10, and attaching the second end 33 of the selected cartridge 20 to the housing 10. The first cartridge 40, comprising a predetermined quantity of hydrocarbon adsorption material, is preferably selected when the predetermined evaporative test and certification conditions comprise a two-day diurnal test plus a hot soak, which is typically required for compliance with LEV and LEV II evaporative emissions standards. The second or third cartridges 42, 44, each comprising a predetermined quantity of hydrocarbon adsorption material and a hydrocarbon scrubber 24, are preferably selected when the predetermined conditions comprise three-day diurnal test plus a hot soak, which is typically required for compliance with PZEV evaporative emissions standards. The two-day diurnal test and hot soak, and the three-day diurnal test and hot soak are based upon regulatory agency requirements and are known to one skilled in the art.

Although this embodiment of the invention is described as a canister assembly 5 which is an integral component of an evaporative emissions control system to manage fuel vapors for a motor vehicle, it is understood that alternate embodiments of this invention exist. An alternate embodiment may include a canister 5 wherein the canister housing 10 is comprised of the purge outlet 14 and the vapor inlet 18 and the air inlet 12, and the cartridge is sealably enclosed therein such that the fuel vapor storage capability of the canister 5 is contained in the cartridge. An alternate embodiment may include a canister without a cartridge chamber 17, wherein the cartridge assembly is sealably assembled to the canister housing 10 via inlet and outlet ports. An alternate embodiment may include a canister wherein the first cartridge 40 contains a hydrocarbon scrubber 24 sealably engaged therein. It is understood that this invention includes any canister assembly 5 employing a cartridge assembly that is used as a component of an evaporative emissions control system, whether remotely mounted in the device or mounted inside the fuel tank, or another location. It is understood that the invention includes an ability to select and insert the cartridge at a component assembly plant, or at a vehicle assembly plant, or any other location. It is understood that the invention includes any canister assembly 5 used as a component of an evaporative emissions control system for any device, including devices that employ stationary engines, vehicles, and motorized tools. The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A canister assembly for capturing and storing fuel vapors from a device, comprising: a housing including: a cartridge chamber, a housing chamber, and a cartridge;

the cartridge chamber fluidly connected to the housing chamber;

the cartridge sealably assembled within the cartridge chamber;

wherein the cartridge is operable to capture and store at least a portion of the fuel vapors from the device.

2. The canister assembly of claim 1, wherein the cartridge comprises any one of a plurality of interchangeable cartridge designs.

3. The canister of claim 2, wherein the cartridge sealably assembled within the cartridge chamber comprises:

the housing including an air inlet fluidly connected to the cartridge chamber;

said cartridge chamber having a sealing surface in the interior portion substantially adjacent the air inlet; wherein a first end of each of the plurality of interchangeable cartridge designs is fluidly sealed to the sealing surface, such that substantially all fluid communication between the air inlet and the cartridge chamber occurs through the first end of the one of the plurality of interchangeable cartridge designs.

4. The canister of claim 3, wherein the housing further comprises a purge outlet, and a vapor inlet; and wherein the purge outlet and the vapor inlet are in fluid communication with a second end of any one of the plurality of interchangeable cartridge designs.

5. The canister of claim 4, wherein one of the plurality of interchangeable cartridge designs comprises a storage chamber containing a predetermined quantity of adsorption material.

6. The canister of claim 5, wherein the canister is operable to adsorb substantially all of the quantity of fuel vapors generated by the device when the predetermined conditions comprise a two-day diurnal test plus a hot soak.

7. The canister of claim 4, wherein the interchangeable cartridge design comprises a storage chamber containing a predetermined quantity of adsorption material and a hydrocarbon scrubber.

8. The canister of claim 7, wherein the canister is operable to adsorb substantially all of the quantity of fuel vapors generated by the device when the predetermined conditions comprise a three-day diurnal test plus a hot soak.

9. The canister of claim 8, wherein the hydrocarbon scrubber is operable to adsorb fuel vapor bleed emissions.

10. The canister 5 of claim 3, wherein there is at least one seal device 30 sealably engaged between the first end 31 of the cartridge and the sealing surface molded into the interior portion of the cartridge chamber of the housing.

11. The canister of claim 4, further comprising the housing chamber operable to provide a fluid conduit for fluid communication between the purge outlet and the vapor inlet and the second end of the one of the interchangeable cartridge designs.

12. The canister of claim 11, wherein the housing chamber contains a predetermined quantity of adsorption material operable to adsorb at least a substantial portion of the quantity of fuel vapors generated by the device during the predetermined conditions.

13. The canister assembly of claim 2, wherein the cartridge chamber comprises an opening within the housing operable to house one of the plurality of interchangeable cartridge designs.

14. The canister of claim 1, wherein each cartridge is interchangeable in the housing.

15. The canister of claim 1, wherein the device comprises a motorized vehicle.

16. The canister of claim 1, wherein the device comprises a hand-held device including an internal combustion engine.

17. The canister of claim 1, wherein the device comprises a stationary internal combustion engine with a fuel source.

18. A method to assemble a canister for adsorbing fuel vapors generated by a device, comprising:

selecting one of a plurality of interchangeable cartridge designs based upon a quantity of fuel vapors generated by the device under predetermined conditions; and, assembling the selected one of the plurality of cartridges to a cartridge chamber of a housing of the canister.

19. The method of claim 18, wherein assembling the selected one of the plurality of interchangeable cartridge designs to the cartridge chamber of the housing of the canister comprises:

inserting a first end of the selected one of the plurality of interchangeable cartridge designs into the cartridge chamber of the housing until the first end sealably engages a sealing surface of the cartridge chamber of the housing cartridge chamber; and, attaching a second end of the selected one of the plurality of interchangeable cartridge designs to the cartridge chamber of the housing.

20. The method of claim 19, wherein selecting one of the plurality of interchangeable cartridge designs based upon the quantity of fuel vapors generated by the device under predetermined conditions comprises selecting a first cartridge comprising a predetermined quantity of adsorption material when the predetermined conditions comprise a two-day diurnal test plus a hot soak.

21. The method of claim 19, wherein selecting one of the plurality of interchangeable cartridge designs based upon the quantity of fuel vapors generated by the device under predetermined conditions comprises selecting a second cartridge comprising a predetermined quantity of adsorption material and a hydrocarbon scrubber when the predetermined conditions comprise three-day diurnal test plus a hot soak.

22. A canister assembly for capturing and storing fuel vapors from a device, comprising a housing including: a cartridge chamber, a housing chamber, a cartridge, and, an air inlet fluidly connected to the cartridge chamber; wherein:

the cartridge, comprising any one of a plurality of interchangeable cartridge designs, is sealably assembled within the cartridge chamber;

the cartridge chamber, comprising an opening within the housing operable to house any one of the plurality of interchangeable cartridge designs and a sealing surface in the interior portion substantially adjacent the air inlet, is fluidly connected to the housing chamber; and, a first end of each of the plurality of interchangeable cartridge designs fluidly sealed to the sealing surface; wherein substantially all fluid communication between the air inlet and the cartridge chamber occurs through the first end of the one of the plurality of interchangeable cartridge designs.

* * * * *